US006554133B1

(12) United States Patent
Kropf et al.

(10) Patent No.: US 6,554,133 B1
(45) Date of Patent: Apr. 29, 2003

(54) CONTAINER PACKAGE FOR PACKAGING ELECTRONIC DEVICES INCLUDING MULTIMEDIA DEVICES SUCH AS ENTIRE COMPUTER SYSTEM INCLUDING A COMPUTER CASE, A MONITOR, AND A PRINTER

(75) Inventors: William C. Kropf, Mountain View, CA (US); Samuel R. Szteinbaum, Los Altos, CA (US); Mark J. Bony, Los Gatos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/614,140

(22) Filed: Jul. 11, 2000

(51) Int. Cl.[7] ..... B65D 85/00; B65D 85/38

(52) U.S. Cl. ..... 206/320; 206/523; 206/576; 206/589; 206/597; 361/683

(58) Field of Search ..... 206/305, 320, 206/523, 589, 576, 597; 361/683, 686, 680

(56) References Cited

U.S. PATENT DOCUMENTS 4,602,715 A * 7/1986 Sarver et al. ..... 206/523
4,790,431 A * 12/1988 Reel et al. ..... 206/523
4,837,590 A * 6/1989 Sprague ..... 206/320
5,058,745 A * 10/1991 Warner et al. ..... 206/523
5,214,574 A * 5/1993 Chang ..... 206/320
5,226,540 A * 7/1993 Bradbury ..... 206/320
5,366,080 A * 11/1994 Carstersen et al. ..... 206/589
5,437,367 A * 8/1995 Martin ..... 206/320
5,647,484 A * 7/1997 Fleming ..... 206/576
5,855,278 A * 1/1999 Harfst ..... 206/576
6,050,419 A * 4/2000 Flanagan et al. ..... 206/597
6,105,765 A * 8/2000 Chu ..... 206/320
6,229,698 B1 * 5/2001 Harvey ..... 361/683

FOREIGN PATENT DOCUMENTS

GB 2229416 * 9/1990 ..... 206/320

* cited by examiner

*Primary Examiner*—Bryon P. Gehman

(57) ABSTRACT

The present invention discloses a container package for an entire computer system. The entire computer system includes at least a computer monitor, a computer case, and a computer printer. The computer case includes a processor and the computer case can be either a horizontal or a tower type case. Advantageously, the present invention provides a container package in which the computer case, monitor and computer printer can all be placed into a single box for shipment and display purposes. The present invention provides a low cost solution for both shipping and for point of display purchase. This environmentally friendly solution reduces the amount of waste that needs to be disposed of after the computer system is unpacked. Further, the present invention makes it more likely that a potential customer will purchase a computer monitor, computer case and computer printer from the same manufacturer.

21 Claims, 5 Drawing Sheets

CONTAINER PACKAGE FOR PACKAGING ELECTRONIC DEVICES INCLUDING MULTIMEDIA DEVICES SUCH AS ENTIRE COMPUTER SYSTEM INCLUDING A COMPUTER CASE, A MONITOR, AND A PRINTER

FIELD OF THE INVENTION

The field of the present invention relates to packaging for computers, computer systems and multimedia devices, and more particularly, to a computer package for holding an entire computer system including a monitor, computer case and a printer. The present invention also relates to a method of packaging an entire computer system into a single box. In addition, the present invention relates to a method of shipping complete computer systems on standardized pallets. The present invention also relates to a point-of-purchase display in which the entire computer system is displayed and a box is located near the displayed computer system that contains the entire computer system.

BACKGROUND OF THE INVENTION

In the past, many approaches have been used for the storing and transportation of computer systems. A computer system includes, for example, a computer case, a monitor and a printer. The computer case would include a processor and could be either a horizontal case or a vertically extending tower case. Other components which form a computer system include a keyboard, a monitor base and cables to connect the various components, which form the computer system.

One approach for shipping and transporting computer systems is to separately box each of the monitor, printer and computer case separately. This frequently occurs when the monitor, printer and computer case including a microprocessor are manufactured by different companies. Another approach is to combine three separate boxes, one for the computer case, another for the monitor and still another for the printer into a single box. Another approach is to box a portion of the computer system including the computer monitor and computer case into one box and the computer printer is in a completely separate box.

Each of the previously mentioned approaches has significant commercial drawbacks. The first approach, requires at least three boxes, adding to cost of the container package, weight of the container package, and overall shipping cost. The overall shipping cost is affected by the volume and weight of the container packages. The second approach has similar drawbacks in that there are significant costs for packaging, excess weight and shipping costs. The third approach also has significant cost and weight penalties. Further, all of the above-mentioned approaches have an adverse environmental impact because there is additional packaging that needs to be disposed of after the computer system is unpacked.

It should be appreciated that an unmet need exists in the art for a container package for packaging an entire computer system which is minimum in size, weight, cost and is environmentally friendly.

SUMMARY OF THE INVENTION

It is, therefore, an object of the present invention to provide a container package for an entire computer system including a monitor, a printer and a computer case.

It is another object of the present invention to reduce the overall dimensions including height, width and depth of a container package for an entire computer system.

It is yet another object of the present invention to provide an environmentally friendly container package for an entire computer system.

Another object of the present invention is to reduce the weight of the container packages used for shipping an entire computer system.

It is another object of the present invention to reduce the shipping costs associated with shipping an entire computer system.

It is still a further object of the present invention to provide a container package that can be used at a point-of-purchase display to entice a customer to purchase an entire computer system from the same manufacturer.

It is still a further object of the present invention to provide a container package on to which eight container packages can be placed on a single standard pallet.

A still further object of the present invention is to provide a single container package for packing a plurality of electronic devices such as multimedia devices.

The present invention is directed to a container package for an entire computer system. The entire computer system includes at least a computer monitor, a computer case, and a computer printer. The computer case includes a processor and the computer case can be either a horizontal or a tower type case. Advantageously, the present invention provides a container package in which the computer case, monitor and computer printer can all be placed into a single box for shipment and display purposes. The present invention provides a low cost solution for both shipping and for point of display purchase. This environmentally friendly solution reduces the amount of waste that needs to be disposed of after, the computer system is unpacked. Further, the present invention makes it more likely that a potential customer will purchase a computer monitor, computer case and computer printer from the same manufacturer.

These and other objects of the present invention are achieved by a container package for holding an entire computer system including a monitor, a computer case and a printer. A first foam insert has a flat bottom surface and a formed upper surface matched to the shape of a portion of the monitor and a portion of the computer case. A second foam insert has a formed lower surface matched to the shape of another portion of the monitor and another portion of the computer case and a formed upper surface matched to a portion of the printer. A third foam insert has a formed lower surface matched to another portion of the printer and a flat upper surface. A container includes a lower portion and an upper portion. The first foam portion is positionable in a lower portion of the container and an upper portion is positionable over the first foam insert, the second foam insert, the third foam insert and the monitor, the computer case, and the printer.

The foregoing and other objects of the present invention are achieved by a method of shipping complete computer systems on standard pallets, wherein each computer system is packaged in an individual container. Each computer system includes a computer case including a processor, a monitor, a printer and accessories. The method includes stacking eight individual containers on the pallet in a 4×2 array with an overall height of the pallet and containers being approximately 53 inches.

The foregoing and other objects of the present invention are achieved by a point-of-purchase display, including a complete computer system including a computer case, a monitor and a printer on display to customers. The container package includes a single box including the complete computer system.

The foregoing and other objects of the present invention are achieved by a method of packaging heterogeneous electronic devices manufactured on a single production line into a single container. The method includes inserting a first foam insert into a bottom portion of the single container. At least one of the heterogeneous electronic devices is positioned into the first molded foam insert. A second foam insert is placed onto the placed at least one heterogeneous electronic device, At least another one of the heterogeneous electronic devices is positioned onto the second foam insert. A third foam insert is placed onto the another one of the heterogeneous electronic devices. A top portion of the single container is located over the first, second and third foam inserts and the at least one of the another heterogeneous electronic devices.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
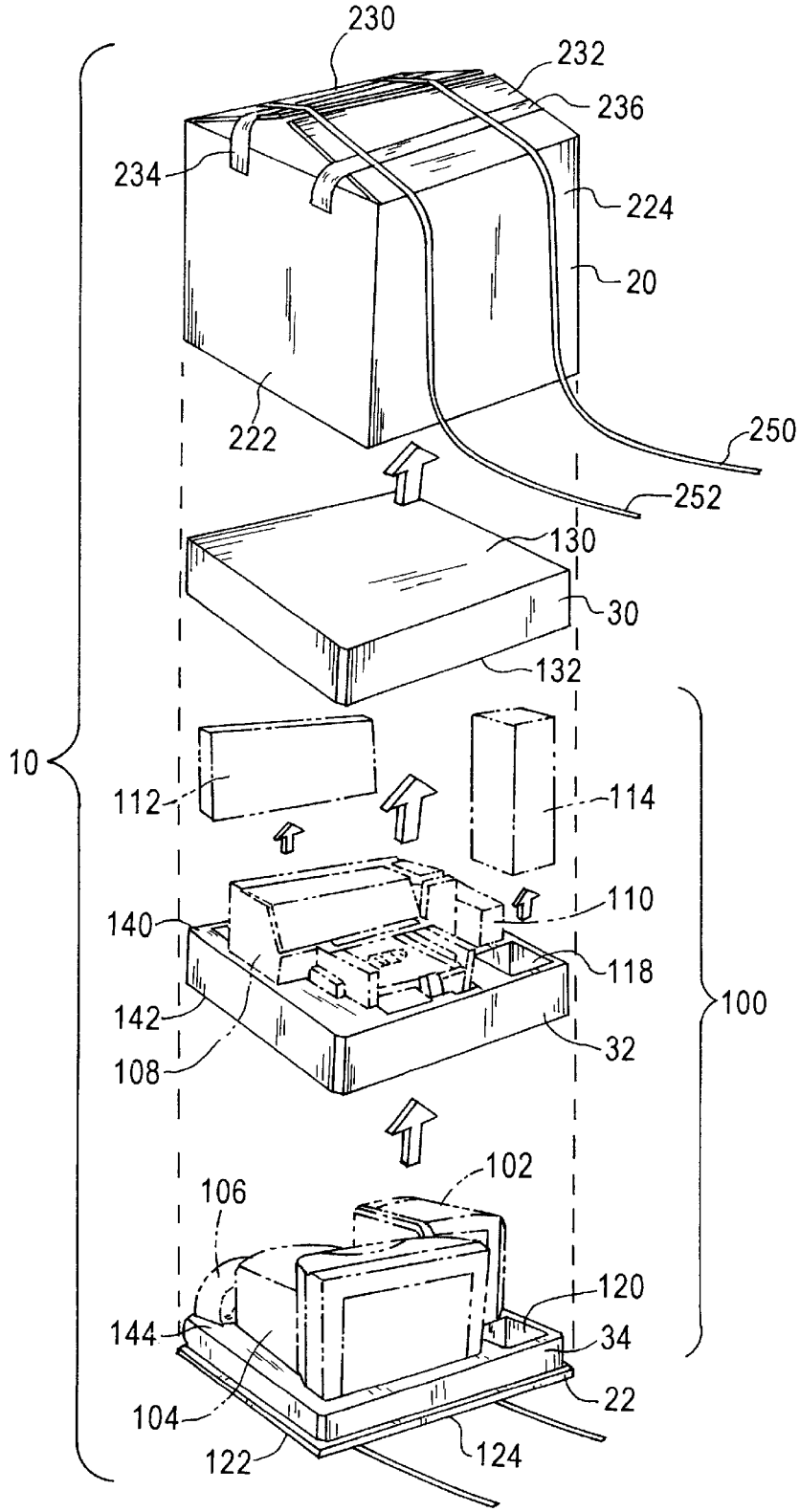
FIG. 1 is an exploded perspective view of a computer container package including a computer system having a monitor, computer case and printer according to the present invention.
Figure 2:
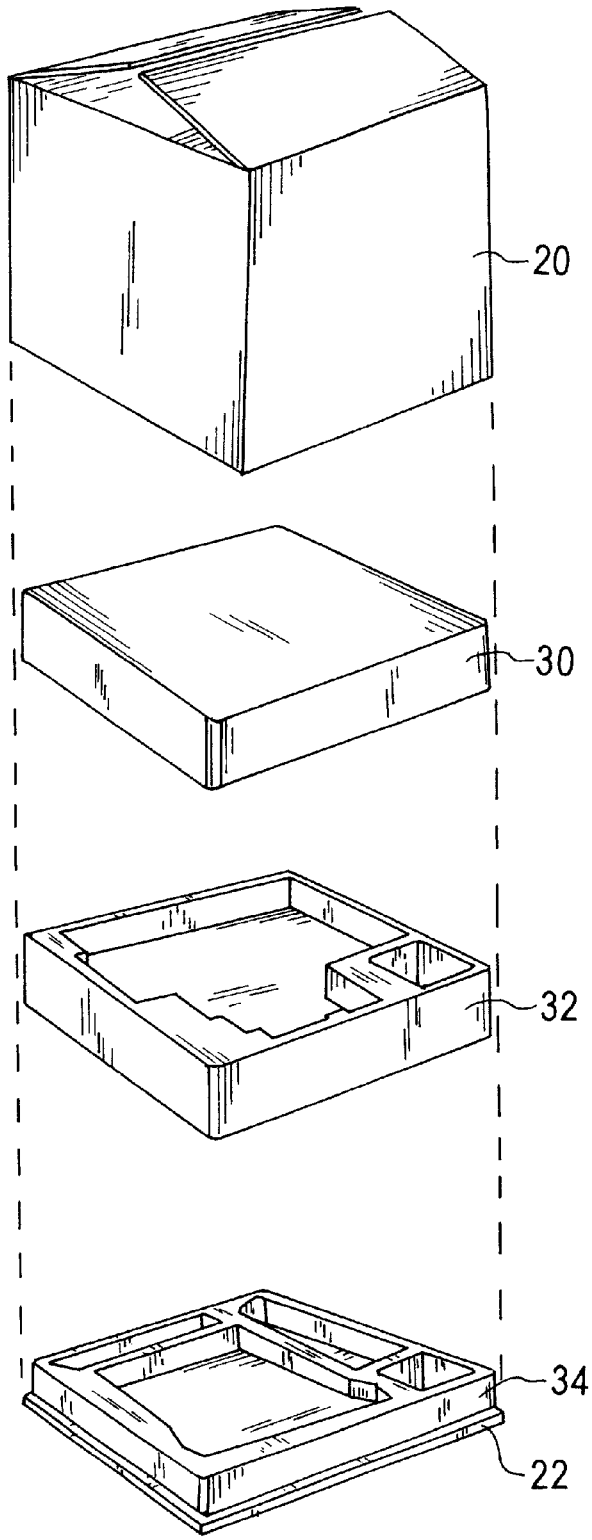
FIG. 2 is an exploded perspective view of the computer container package similar to FIG. 1.

Referring now to FIG. 1, a container package 10 for an entire computer system 100 is depicted in accordance with the present invention. The container package 10 includes a cardboard container including a sleeve 20 and a tray 22. Also, as part of the container package 10, there is a top foam insert 30, a middle foam insert 32 and a bottom foam insert 34. The cardboard container portions 20, 22 are manufacturer from corrugated cardboard. The foam inserts 30, 32, 34 are manufactured from expanded polystyrene. Alternatively and less preferably, the cardboard container can be a one piece construction. The computer system 100 includes a computer case 102, which is shown as a mid-tower case. Other cases could include a horizontal case and other known cases as well. A computer monitor 104 is included along with a monitor base 106. A computer printer 108 forms part of the entire computer system. As depicted, the printer 108 is an Ink Jet printer although other printers, such as a laser printer could be included. A keyboard is included in a box 112. One or more speakers are included in a box 110. Other accessories such as cables and the like are included in a box 114. Alternatively, other electronic devices such as multimedia devices including digital cameras, scanners, printers, personal digital assistants and the like can also be included. Alternatively, instead of a computer system the principles of the present invention can also be applied to heterogeneous multimedia devices. The computer container package 10 is depicted in FIG. 2 without the entire computer system 100, for clarity.

Figure 3A:
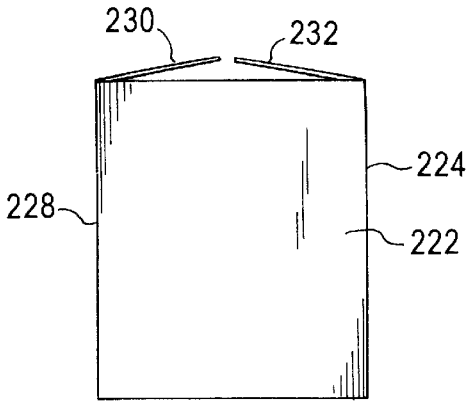
FIG. 3A is a right side view of a top section of cardboard box.
Figure 3B:
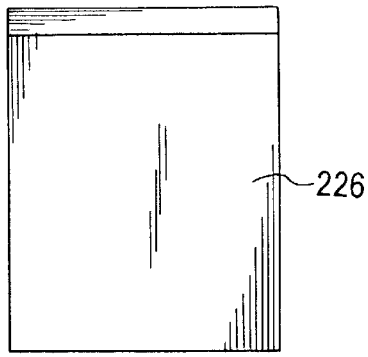
FIG. 3B is a left side view of the cardboard box of FIG. 3A.
Figure 3C:
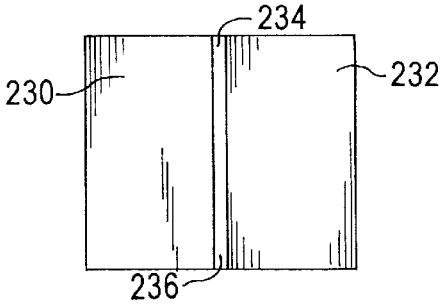
FIG. 3C is a top view of the cardboard box of FIG. 3A.
Figure 3D:
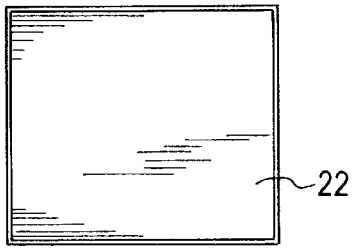
FIG. 3D is a bottom view of the cardboard box of FIG. 3A.
Figure 4A:
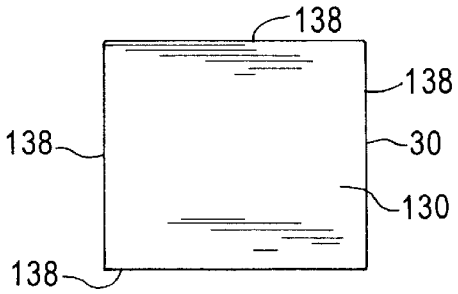
FIG. 4A is a top view of a top insert.
Figure 4C:
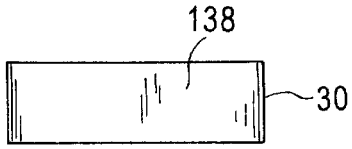
FIG. 4C is a side view of the insert of FIG. 4A.
Figure 4B:
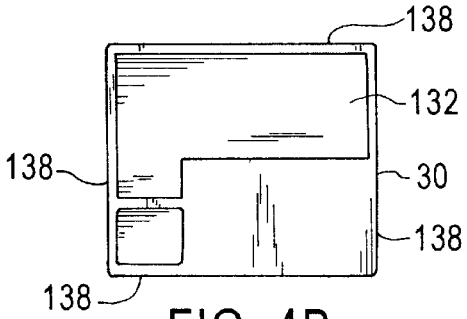
FIG. 4B is a bottom view of the insert of FIG. 4A according to the present invention.
Figure 5A:
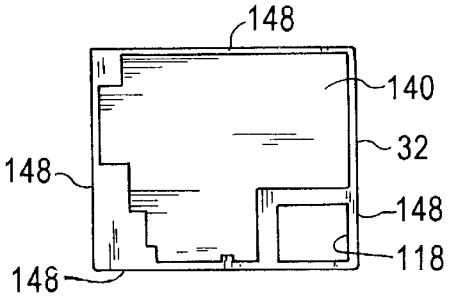
FIG. 5A is a top view of a middle insert.
Figure 5B:
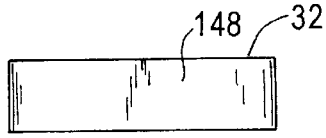
FIG. 5B is a side view of the middle insert of FIG. 5A.
Figure 5C:
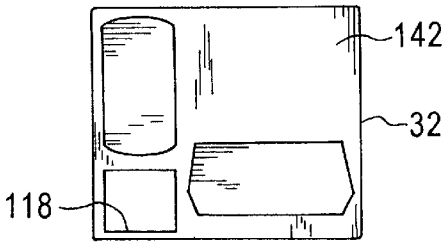
FIG. 5C is a bottom view of the insert of FIG. 5A according to the present invention.
Figure 6B:
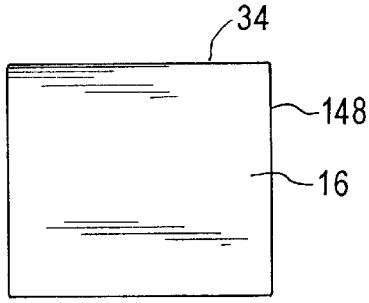
FIG. 6B is a bottom view of the bottom insert of FIG. 6A.
Figure 6A:
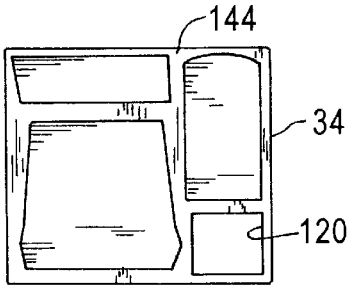
FIG. 6A is a top view of a bottom insert according to the present invention.
Figure 6C:
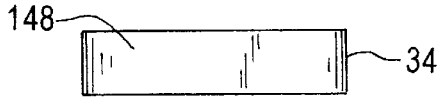
FIG. 6C is side view of the bottom insert of FIG. 6A.
Figure 7A:
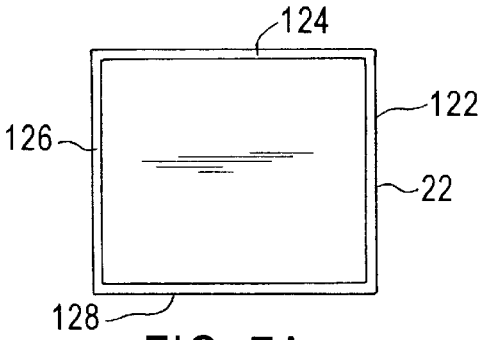
FIG. 7A is a top and bottom view of a bottom section of the cardboard box.
Figure 7B:
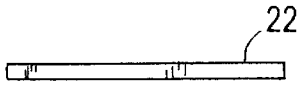
FIG. 7B is a side view of the card board box of FIG. 7A.

As depicted in FIG. 1, the lower portion 22 of the cardboard box has an overall height of two inches. The tray 22 has four walls 122, 124 and 126, 128 (see FIG. 7A). These walls 122–128 are formed at a periphery of the tray 22. Advantageously, the short tray 22 makes the container package 10 easy to pack and easy to unpack. Ease of unpacking is important as it enhances a customer's out of box experience. The sleeve 20 has four vertically extending walls 222, 224 and 226 and 228 (see FIGS. 3A and 3B). A pair of flaps 230, 232 are conventional as are interior flaps (see FIG. 3C). FIG. 3D is a bottom view of the tray 22.

As depicted in FIGS. 1 and 4A, 4B and 4C, the upper insert 30 has a flat upper surface 130 and a formed lower surface 132 which has a shape matched to that of the top of printer 108, the top of keyboard box 112, the top of speaker box 110 and the top of accessory box 114. The upper insert 30 has four exterior side walls 138 which form a rectangular shape to conform to the interior surface of the sleeve 20 of the container 10.

Similarly, as depicted in FIGS. 1 and 5A, 5B and 5C, the middle insert 32 has a top surface 140 having a shape which conforms to the bottom portion of the printer 108, and has a rectangular through hole 118 through which the accessory box 114 is inserted, and into which a lower portion of the box 110 and the box 112 are inserted. The middle insert 32 has a lower surface 142 for receiving a top portion of the computer case 102, top portion of the monitor 104, and a top portion of monitor base 106. The middle insert 32 has four exterior side walls 148 which form a rectangular shape to conform to the interior surface of the sleeve 20 of the container 10.

The lower insert 34 has an upper surface 144 having a shape matching a lower portion of the monitor 104, a lower portion of the base 106, and a lower portion of the computer case 102. There is also a rectangular recess 120 for receiving a lower portion of the accessory box 114. The recess 120 is aligned with the rectangular through hole 118. The lower insert 34 has four exterior side walls 158 which form a rectangular shape to conform to the interior surface of the sleeve 20 of the container 10. Each of the inserts 30, 32, 34 has the peripheral dimensions.

A pair of handles 234, 236 extend across the flaps 230, 232, respectively. The handles 234, 236 are tape and lie flush along the flaps 230, 232 but have some "give" to allow one to get their hands underneath. Advantageously, after each of the components 102–114 has been placed into the respective inserts 34, 32, 30 and the sleeve 20 has been placed upon the tray 22, a plurality of conventional straps 250, 252 are used to close the container package 10. In the completed package assembly, the overall height of the package is only 24 inches and the width dimension is 24 inches and the depth dimension is 19⅞ inches. The entire package weighs less than 75 pounds as depicted in FIG. 1. Although not shown, each of the components is wrapped in a low density polyethylene polybag which are recyclable. As compared with previous packaging systems, there is less waste disposal associated with the present invention and therefore the present invention is environmentally friendly. Instructions are printed on at least one surface, for example, the surface of flap 232 for unpackaging the computer system from the container package 10. Advantageously, eight of these completed container packages 10 can be placed on a standard pallet with four container packages 10 being placed directly on the pallet and stacked two high for a total of eight container packages 10. This amounts to a significant cost savings in shipping both in terms of having fewer boxes and therefore less costs associated with the purchase of cardboard containers and foam inserts as well as reduced shipping costs by truck or rail. For example, using a 110 inch inside truck dimension for a standard eighteen wheel truck, and using eight container packages 10 per pallet and with the pallets stacked too high, 480 container packages 10 can be placed into a single truck.

Figure 8:
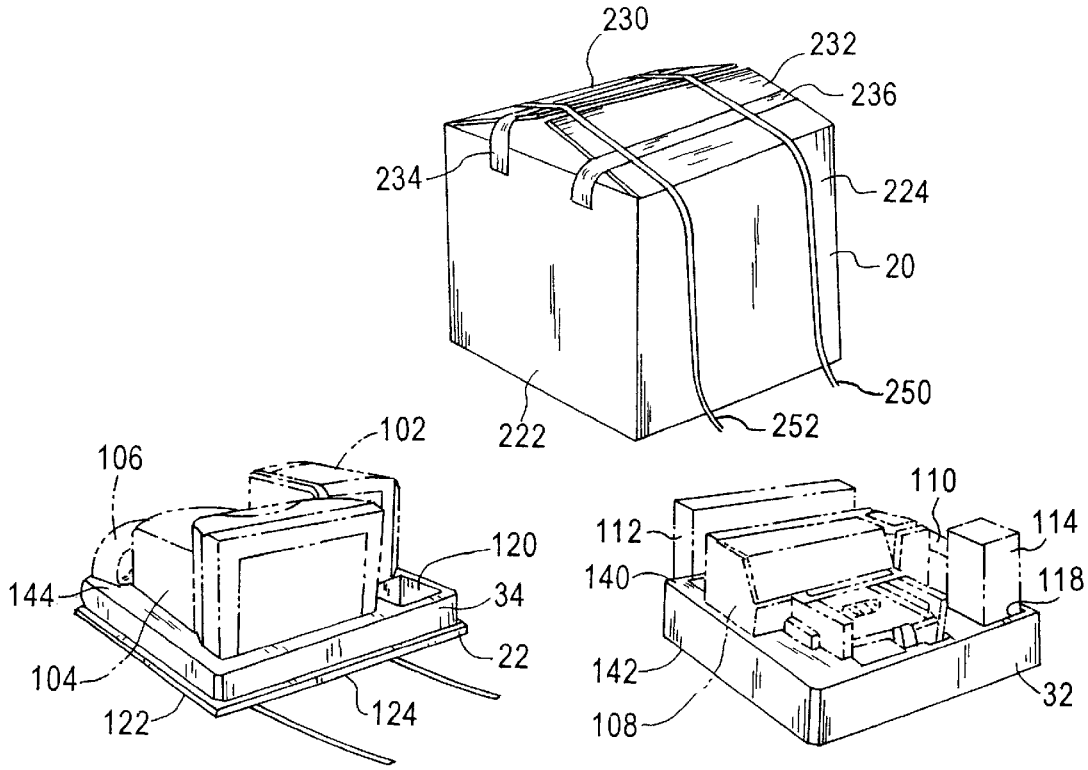
FIG. 8 is a perspective view of a preferred embodiment of a point of purchase display of the present invention.

Further, the present invention provides enticement for a consumer to purchase an entire computer system from the same company. In the past, a consumer might purchase a monitor from one manufacturer, a computer processor from another company and a printer from yet a third company. Because of the ease of display and the ease of transport, and ease of unpacking and ease of set up using the present invention, it is more likely that a consumer will purchase an entire computer system in a single box from the same manufacturer. A point of purchase display of the present invention is shown in FIG. 8.

As compared to prior art packaging systems, there is at least a fifty percent size and volume reduction as compared to prior art container systems. Thus, retailers and shippers can more easily ship and store entire computer systems using the present invention. Also advantageously, the present invention can be fit into the trunk of automobiles, including a Saturn sedan, a Porsche, BMW, Taurus wagon, Jetta, convertible Mustang and a Mazda Miata.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A container package for holding an entire computer system including a monitor, a computer case and a printer, comprising:

a first foam insert having a flat bottom surface and a formed upper surface matched to the shape of a portion of the monitor and a portion of the computer case;

a second foam insert having a formed lower surface matched to the shape of another portion of the monitor and another portion of the computer case and a formed upper surface matched to a portion of the printer;

a third foam insert having a formed lower surface matched to another portion of the printer and a flat upper surface;

a container including a lower portion and an upper portion, said first foam insert positionable in said lower portion of said container and said upper portion positionable over said first foam insert, said second foam insert, and said third foam insert.

2. The container package of claim 1, wherein the computer system further comprises a keyboard container and said upper surface of said first foam insert has a portion of said upper surface matched to the shape of the keyboard container and said second foam insert has a portion matched to the shape of the keyboard container.

3. The container package of claim 1, wherein said container package has a 24 inch height.

4. The container package of claim 3, wherein said container package has a 19⅞ inch depth and a 24 inch width.

5. The container package of claim 1, wherein said lower portion of said container has approximately a two inch height and said upper portion of said container has an approximate 24 inch height.

6. The container package of claim 1, wherein said container is made of corrugated cardboard.

7. The container package of claim 1, wherein said foam inserts are made of expanded polystyrene.

8. The container package of claim 1, wherein said container package has a 24 inch height, a 19⅞ inch depth and a 24 inch width.

9. The container package of claim 1, wherein said container package weighs less than 75 pounds.

10. The container package of claim 1, wherein the computer system further includes cables, and a monitor base.

11. A point-of-purchase display, comprising:

a complete desktop computer system including a computer case, a monitor and a printer on display to customers;

a container package including another complete computer system; wherein the container package includes:

a first foam insert having a flat bottom surface and a formed upper surface matched to the shape of a portion of the monitor and a portion of the computer case;

a second foam insert having a formed lower surface matched to the shape of another portion of the monitor and another portion of the computer case and a formed upper surface matched to a portion of the printer;

a third foam insert having a formed lower surface matched to another portion of the printer and a flat upper surface; and a container including a lower portion and an upper portion, said first foam insert positionable in the lower portion of the container and said upper portion positionable over said first foam insert, said second foam insert, and said third foam insert.

12. The display of claim 11, wherein the computer system further comprises a keyboard container and the upper surface of the first foam insert has a portion of the upper surface matched to the shape of the keyboard container and the second foam insert has a portion matched to the shape of the keyboard container.

13. The display of claim 11, wherein the container package has a 24 inch height.

14. The display of claim 13, wherein the container package has a 19⅞ inch depth and a 24 inch width.

15. The display of claim 11, wherein the tray has approximately a two inch height and said sleeve has an approximate 24 inch height.

16. The display of claim 11, wherein the container is made of corrugated cardboard.

17. The display of claim 11, wherein the foam inserts are made of expanded polystyrene.

18. The display of claim 11, wherein the container package has a 24 inch height, a 19⅞ inch depth and a 24 inch width.

19. The display of claim 11, wherein the container package weighs less than 75 pounds.

20. A method of packaging heterogeneous electronic devices into a single container, the method comprising the steps of:

inserting a first foam insert into a bottom portion of the single container;

positioning at least one of the heterogeneous electronic devices into the first molded foam insert;

placing a second foam insert onto the positioned at least one heterogeneous electronic device;

positioning at least another one of the heterogeneous electronic devices onto the second foam insert;

placing a third foam insert onto another one of the heterogeneous electronic devices;

locating a top portion of the single container over the first, second and third foam inserts and the at least one and the another heterogeneous electronic devices.

21. The method of claim 20, wherein the heterogeneous electronic devices are multimedia devices.

* * * * *